United States Patent [19]

Lapeyre

[11] Patent Number: 4,627,200

[45] Date of Patent: Dec. 9, 1986

[54] RECESSED MORTISE STAIR

[75] Inventor: James M. Lapeyre, New Orleans, La.

[73] Assignee: The Laitram Corporation, New Orleans, La.

[21] Appl. No.: 586,099

[22] Filed: Mar. 5, 1984

[51] Int. Cl.[4] ..... E04F 11/00

[52] U.S. Cl. ..... 52/191; 182/228

[58] Field of Search ..... 182/228, 194, 93, 94, 182/113; 52/182, 191

[56] References Cited

U.S. PATENT DOCUMENTS

| | | | |
|---|---|---|---|
| 11,718 | 6/1899 | Wilkinson | 52/182 |
| 71,049 | 11/1867 | Page | 182/228 |
| 395,467 | 1/1889 | Welsh et al. | 182/113 |
| 3,727,721 | 3/1972 | Kulesa | 182/113 |
| 4,061,202 | 12/1977 | Campbell | 182/20 |
| 4,199,040 | 4/1980 | Lapeyre | 182/93 |
| 4,367,613 | 1/1983 | Strub | 52/191 X |
| 4,509,617 | 4/1985 | Lapeyre | 182/228 X |

FOREIGN PATENT DOCUMENTS

| | | | |
|---|---|---|---|
| 164308 | 3/1949 | Austria | 182/194 |
| 2358745 | 1/1975 | Fed. Rep. of Germany | 52/182 |
| 730678 | 8/1932 | France | 182/228 |
| 2516136 | 5/1983 | France | 52/182 |

OTHER PUBLICATIONS

Cleo Learning Aids, "Foot Placement Ladder" Prior to 2/28/76.

*Primary Examiner*—Carl D. Friedman

*Attorney, Agent, or Firm*—Weingarten, Schurgin, Gagnebin & Hayes

[57] ABSTRACT

A stair having a central stringer and two side stringers adapted for mounting between an upper level and a lower level at a relatively steep angle of inclination. A plurality of tread members are disposed in alternating arrangement on respective sides of the central stringer and each tread member extends laterally from the central stringer to the respective side stringer. The tread members, which are substantially identical in shape, mateably join the central stringer and respective side stringers at tread member ends with a dovetail joint having a recessed mortise defining tread supporting shoulders. Handrails are provided at an angle substantially parallel to the stringers and of a height to support a user while descending the stair. Typically an upper tread member is provided which is even with the upper level. The stair is of a structure which permits disassembled shipment as a relatively compact, lightweight package and ease of assembly at a location of intended use.

14 Claims, 12 Drawing Figures

RECESSED MORTISE STAIR

FIELD OF THE INVENTION

This invention relates to stairs and ladders, and more particularly to an alternating half tread three stringer stair which can be installed at relatively steep angles of inclination, and in which tread members mateably join the central stringer with respective side stringers.

BACKGROUND OF THE INVENTION

Stairs and ladders permitting ascent and descent between two levels have employed a wide variety of construction techniques to accomplish this well known function. Stairs are typically shipped as a relatively bulky pre-assembled unit or are fabricated and installed at the location of intended use. The need exists for lightweight stairs which may shipped in a knocked down or disassembled configuration to minimize shipping bulk and the associated cost of transport while permitting final assembly at the destination or use location. Moreover, it is desirable that such a stair permit ascent and descent at relatively steep angles of inclination to minimize use of valuable floor space. The minimization of floor space use is of particular significance aboard ships, vessels, and other locations where space is at a premium. Stairs and ladders known in the art are deficient in one or more of these aspects.

U.S. Pat. No. 3,110,132 discloses a pre-fabricated stair which provides for assembly of the stair without scaffolding at an intended use location. This stair includes a central supporting stringer and tread members which mateably engage the central stringer. The stair has parallel tread members and is not adapted to be disposed at steep angles of inclination.

U.S. Pat. No. 4,199,040 to the same inventor and assignee as the present invention discloses an alternating tread ladder adapted for use at relatively steep angles of inclination. This ladder is typically assembled at a place of manufacture and installed at a remote use location.

U.S. Pat. Nos. 4,061,202 and 4,069,892 disclose single stringer modular ladders which may be assembled and installed at a final use location.

SUMMARY OF THE INVENTION

The present invention comprises a three stringer stair having a central stringer and two side stringers adapted for mounting between an upper level and a lower level at a relatively steep angle of inclination. The stair in accordance with the invention is adapted to be precut, formed and shipped disassembled for remote installation and assembly. The stair includes a plurality of tread members disposed in an alternating arrangement on respective sides of the central stringer. The tread members extend laterally from opposing sides of the central stringer and mateably join the central stringer with the respective side stringers.

Side stringers are elongated members of substantially rectangular cross section, and are formed with an upper end portion intended to abut a normally vertical wall or surface. The central stringer is substantially identical in shape to the side stringers but may extend above the upper level to guide the foot of a user and to provide greater safety of use upon entry or exit of the stair. Mounting panels may be fastened to the stringers adjacent the upper and lower levels, and respective panels may be fastened to the vertical wall and the lower level to fixably position the stair.

Tread members, which are typically rectangular in shape, are joined to the stringers at opposing ends in a preferred embodiment by recessed dovetail joints. The tread members are provided with dovetail tenons on opposing ends and recessed mortises are appropriately located in the side and central stringers so as to slideably receive and engage respective tread member tenons. Mortises are oriented at an angle in the side and central stringers so that the tread members will lie in a normally horizontal plane upon mateable engagement with the respective stringers. Tread members may be carpeted using first and second carpet runners for tread members on opposing sides of the central stringer.

Handrails are typcially provided above and substantially parallel to one or both side stringers. Handrails are typically supported by members extending from the handrail to the side stringer. Terminal members may be employed to join respective handrails and handrail supports. Each terminal member is substantially triangular in shape and has a cylindrical bore which is mateable with the vertical handrail support. The upper portion of the terminal member is adapted to mateably engage the handrail.

Stringer weight may be reduced by fabricating each side stringer from two elongated parallel members connected by normally horizontal interconnecting cross members. Alternatively, substantially solid stringers may be provided with apertures to reduce the weight of the stair in accordance with the present invention.

DESCRIPTION OF THE DRAWINGS

The invention will be more fully understood from the following detailed description in conjunction with the accompanying drawings, in which.

DETAILED DESCRIPTION OF THE INVENTION

Figure 1:
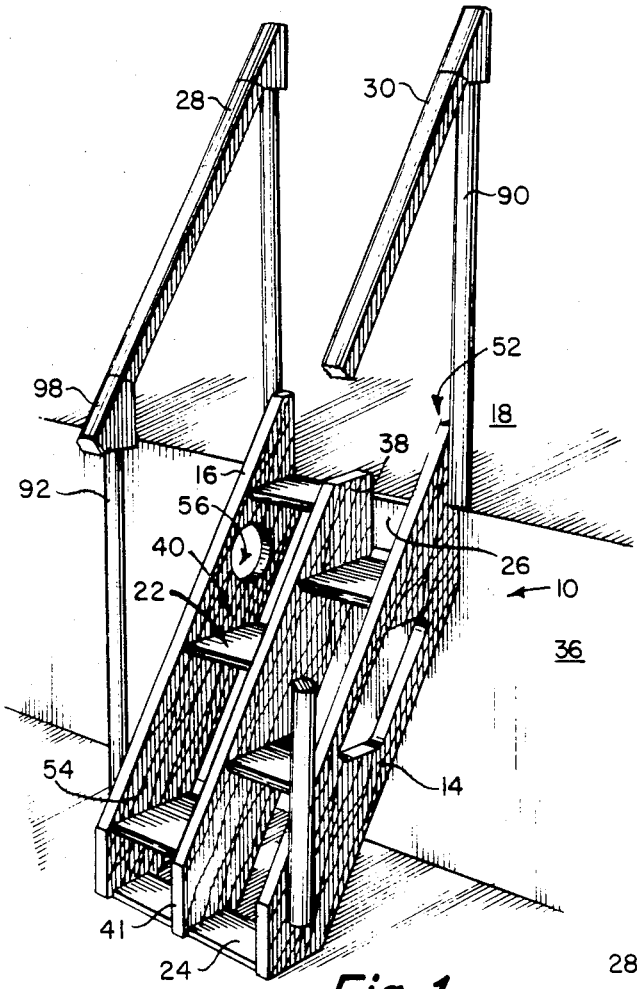
FIG. 1 is a perspective view of a preferred embodiment of the stair in accordance with the present invention.

With reference now to FIGS. 1 through 12, the present invention provides a stair 10 which may be compactly shipped or stored as a plurality of disassembled elements and readily assembled and installed at a location of intended use. A central stringer 12 and two side stringers 14 and 16, are adapted to lie at a predetermined, relatively steep angle of inclination in a use position, between an upper level 18 and a lower level 20. Tread members 22 are disposed in an alternating manner on respective sides of the central stringer 12 and extend laterally to respective side stringers 14 and 16. Mounting panels 24 and 26 are provided to rigidize the stringers 12, 14 and 16, and may be used to fix the stair in position at the upper and lower levels 18 and 20. Handrails 28 and 30 are provided for increased comfort and safety. Typically, the stringers 12, 14, and 16 of the present stair 10 are adapted to be disposed at an angle of inclination $\theta$ greater than 45 degrees to the lower level 20.

Figure 2:
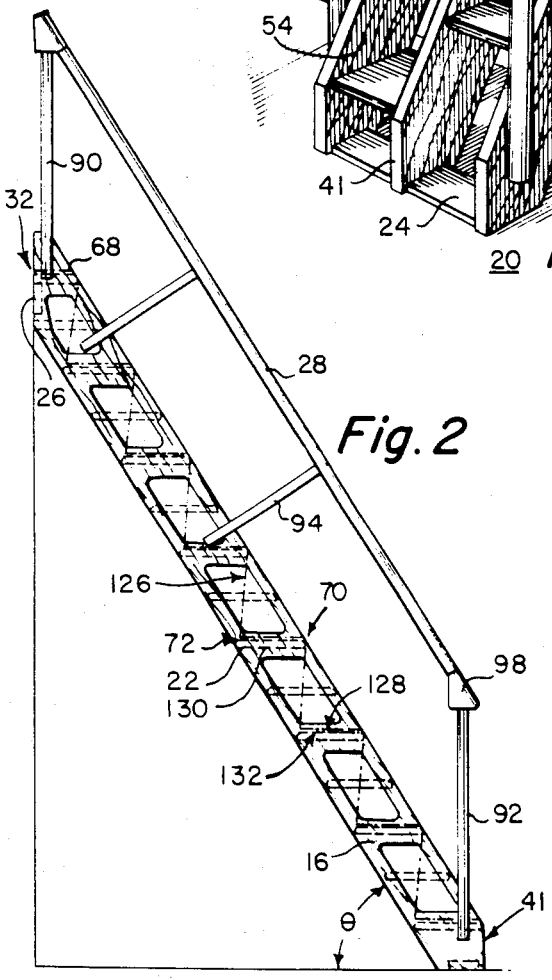
FIG. 2 is a side elevation view of a stair in accordance with the present invention.
Figure 4:
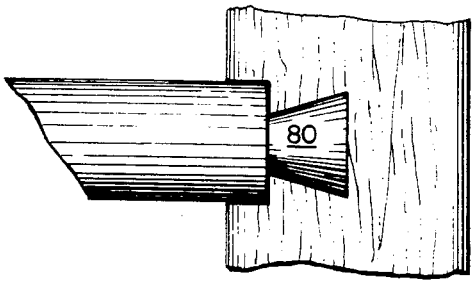
FIG. 4 is an enlarged side view of the recessed mortise dovetail joint.
Figure 5:
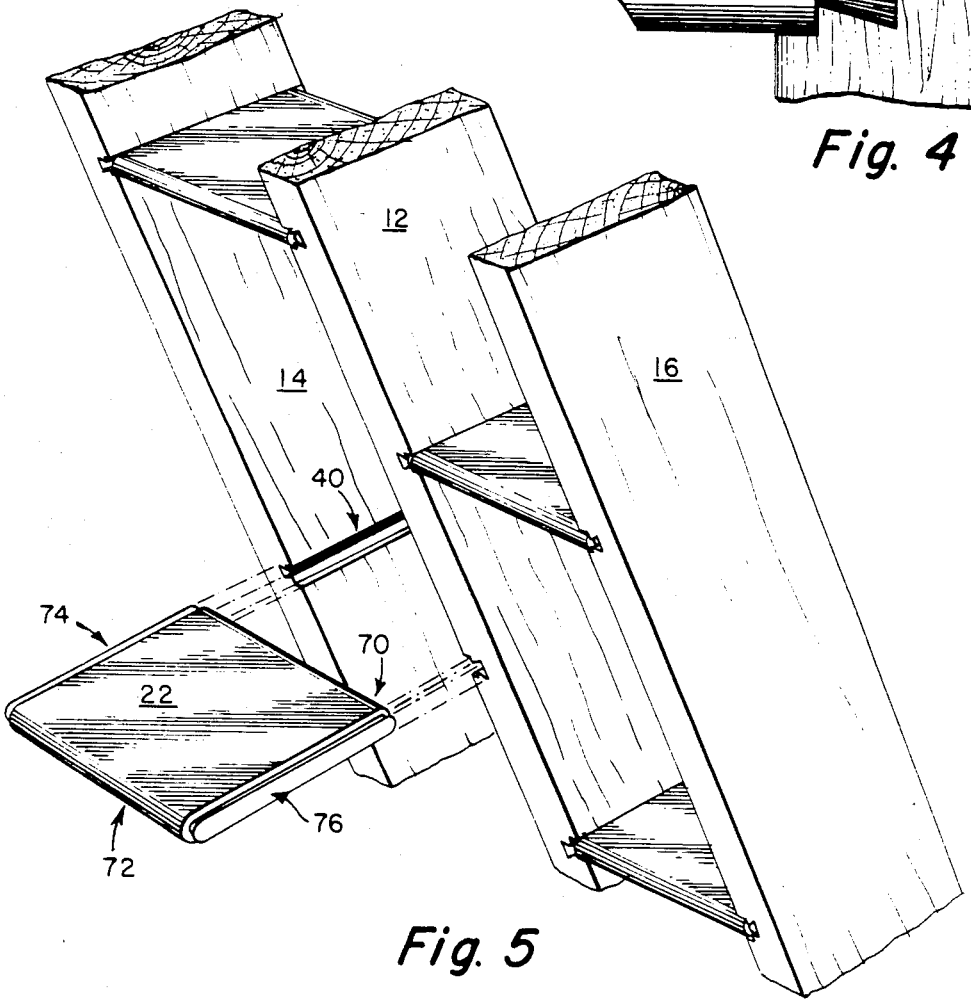
FIG. 5 is a partial perspective view of the stair of FIG. 1 showing a tread member removed.
Figure 6:
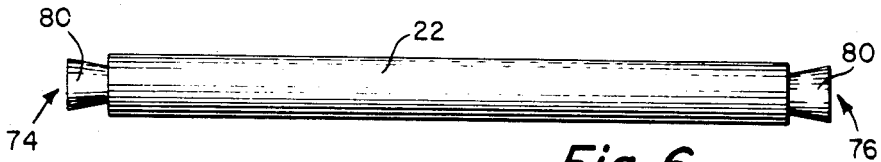
FIG. 6 is a front view of a tread member in accordance with the present invention.
Figure 7:
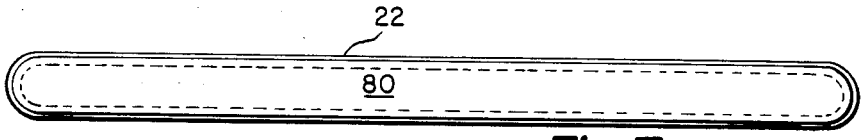
FIG. 7 is a side view of the tread member of FIG. 6.
Figure 8:
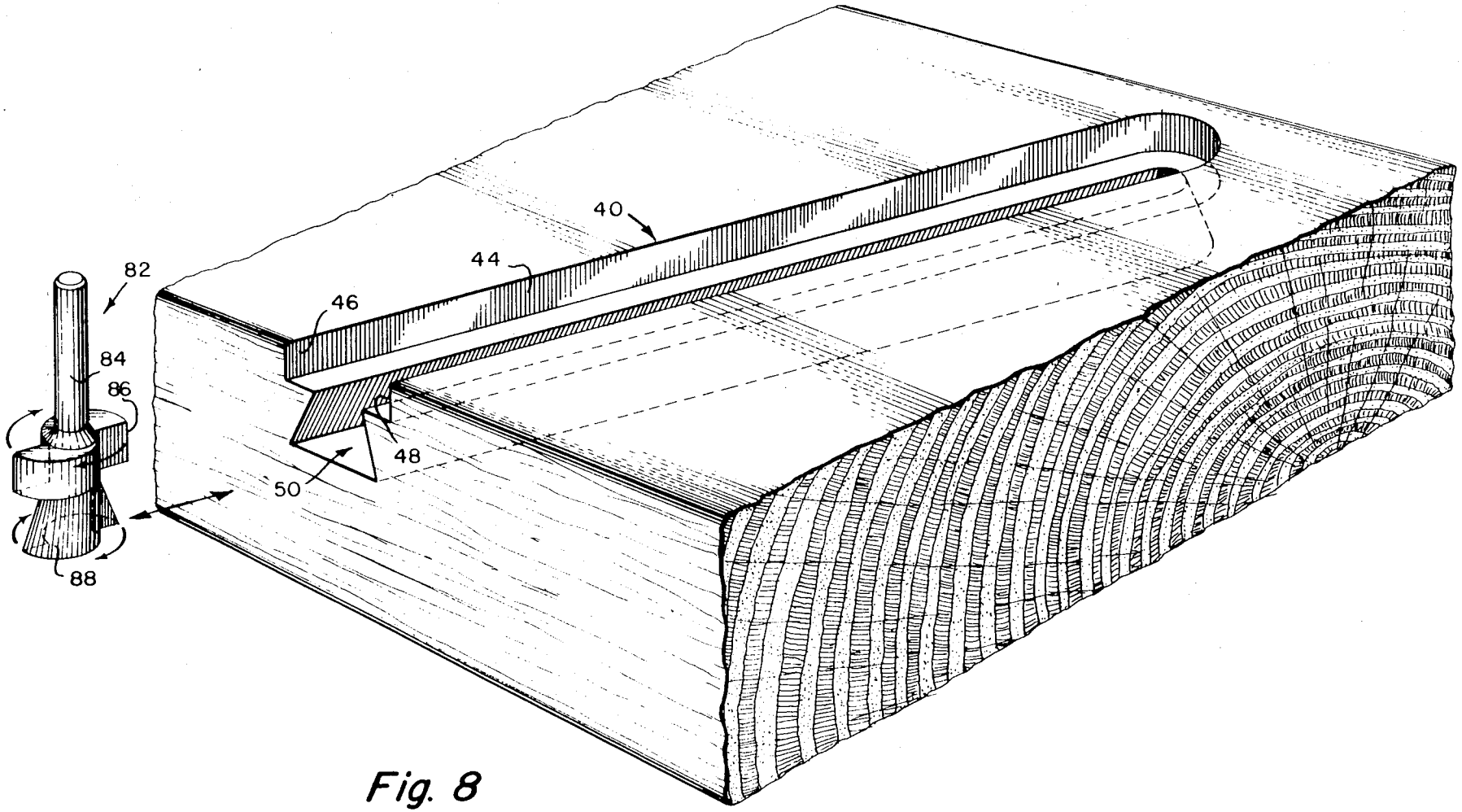
FIG. 8 is a partial perspective view of a stringer, showing the recessed mortise dovetail joint in accordance with the present invention and a router bit for simultaneous cutting of the recess and mortise.
Figure 9:
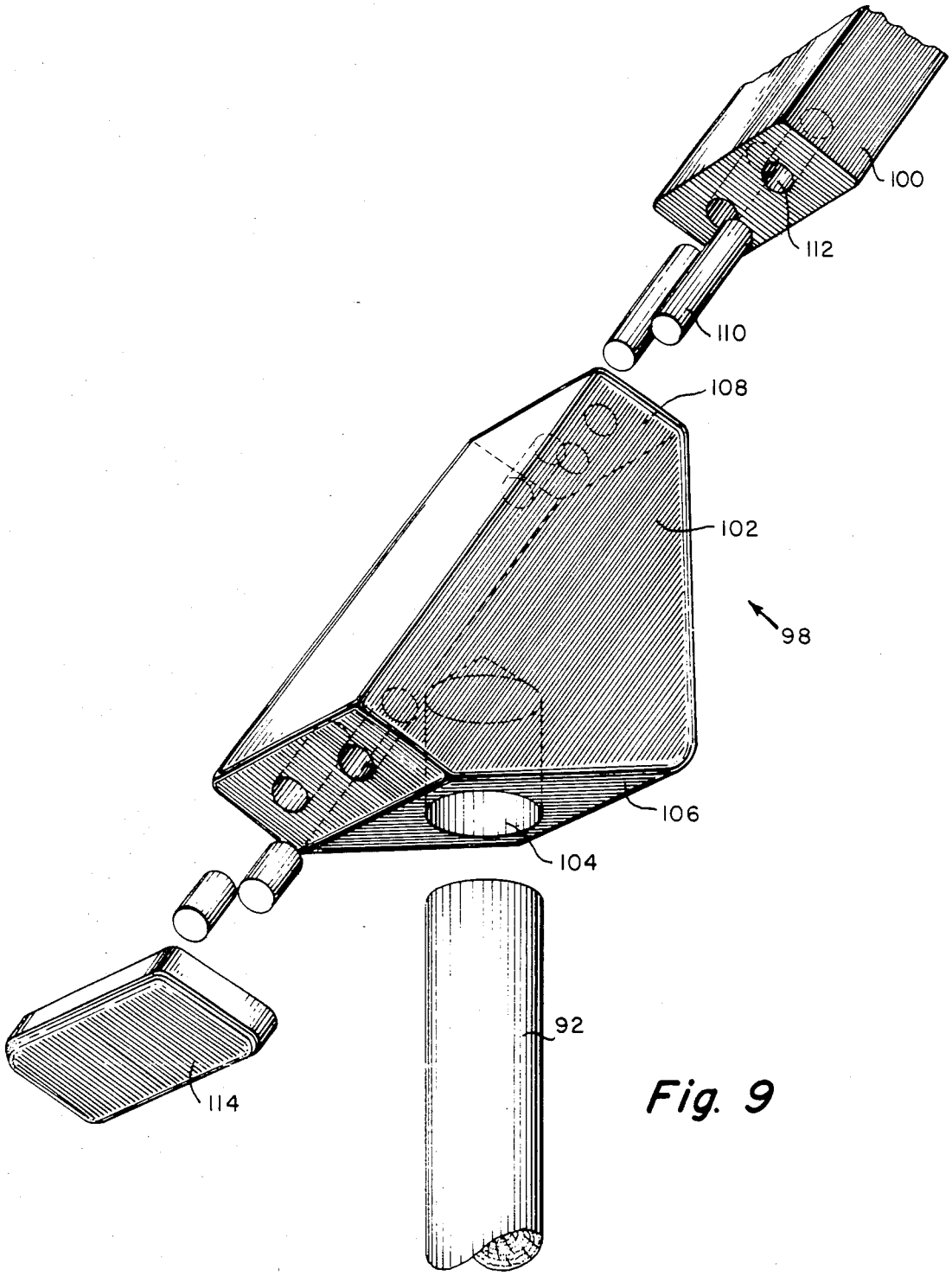
FIG. 9 is an exploded perspective view of a terminal member.

The central stringer 12 is an elongated member adapted to extend between an upper level 18 and a lower level 20. The central stringer 12, in a preferred embodiment, is of substantially rectangular cross section, and is provided with a vertical profile 32 proximate to the upper level 18, and a horizontal profile 34 intended to confront the lower level 20. In its use position, the central stringer 12, horizontal profile 34 rests on the lower level 20, and the vertical profile 32 confronts the supporting vertical wall 36 near the upper level 18. In addition, the central stringer 12 may include a portion 38 projecting slightly above the upper level 18, which serves to guide a user's foot while entering or exiting the stair. To minimize floor space use and further reduce weight, the central stringer may be truncated at the lower end, forming a vertical profile 41 as shown in FIG. 2. The central stringer 12 is provided with substantially horizontal recessed mortises 40 extending along opposing sides of central stringer 12. As shown in FIGS. 4, 5 and 8, the recessed mortises 40 include a longitudinal recess 44 defining upper and lower shoulders 46 and 48 respectively, and a dovetail mortise 50 centrally disposed with respect to the recess 44. The recessed mortises 40 extend longitudinally across the respective sides of central stringer 12, at a specified angle such that tread members 22 are normally horizontal when tread members 22 are engaged in respective recessed mortises 40.

Side stringers 14 and 16 are substantially similar to the central stringer in shape. Recessed mortises 40 are only provided in the sides 52 and 54 of side stringers 14 and 16 respectively, facing the central stringer 12 and mortises 40 are disposed in corresponding opposed relation to mortises 40 in the central stringer 12. Each of the stringers 12, 14, 16 may be provided with apertures of various shapes 56 to improve stair 10 aesthetics while reducing overall weight.

Figure 10:
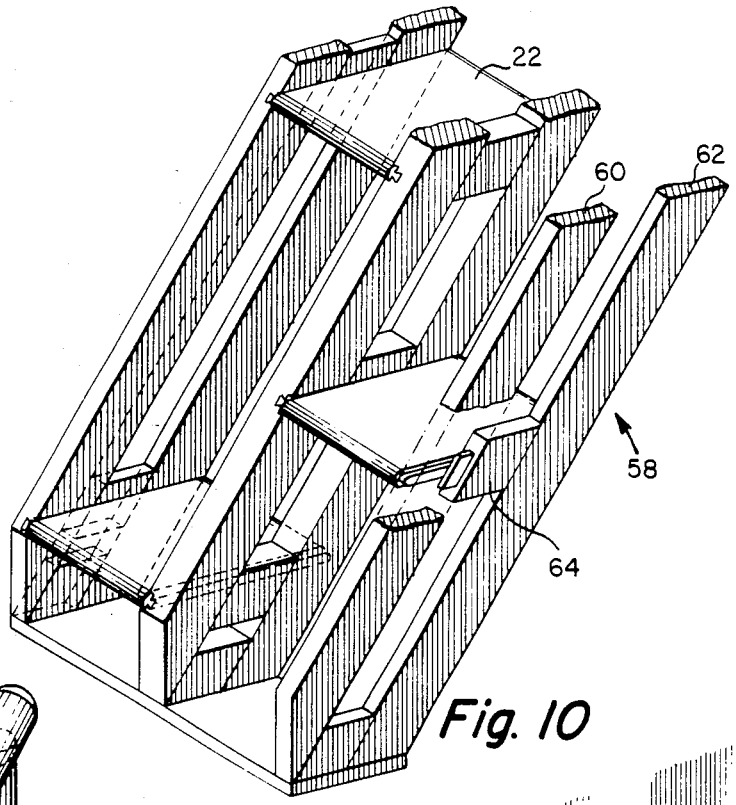
FIG. 10 is a partial perspective view of a stair having multi-piece stringers.

In another embodiment shown in FIG. 10 the stringers 58 are formed from a plurality of separate components to minimize material usage while reducing stair weight. The stringers 58 include elongated front and rear members 60 and 62 respectively, and cross members 64 joining the front and rear members. Recessed mortises 40 extend transversely through the front and rear members 60, 62 and through the cross members 64 to provide maximum tread member support.

Figure 3:
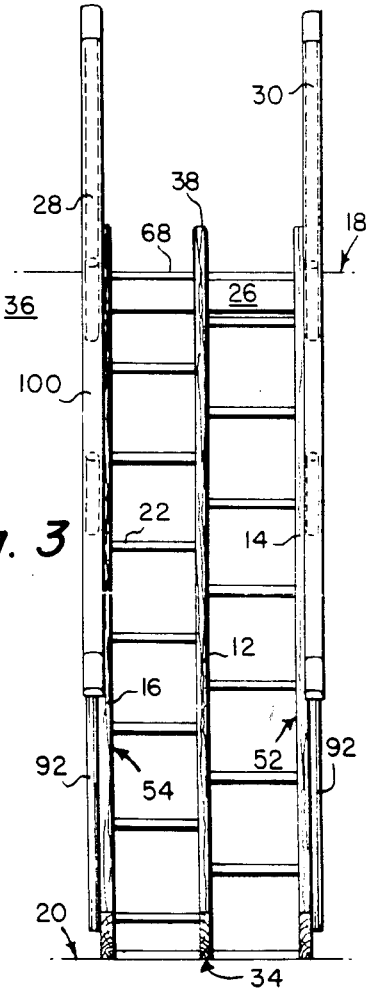
FIG. 3 is a front view of the stair of FIG. 2.

Tread members 22 are of sufficient width to accommodate the foot of a user, and are typically rectangular in shape. To facilitate ascent at steep angles of inclination, the tread members 22 are disposed in an alternating arrangement on respective sides of the central stringer 12. As illustrated in FIG. 3, the upper surface of the uppermost tread member 68 is essentially coplanar with the upper level 18, the projecting portion 38 extending above the uppermost tread member 68 and upper level 18. The uppermost tread member 68 is typically of width approximately half that of other tread members 22 to further facilitate ease and safety of stair 10 entry and exit.

Referring to FIGS. 4–8, the tread members 22 have a front edge 70, a back edge 72, and sides 74 and 76. In a preferred embodiment of the invention, the sides 74 and 76 of tread members 22 slideably engage the recessed mortises 40 in the stringers to form a locking recessed dovetail joint 48. Dovetail tenons 80 are disposed along the sides 74 and 76 of the tread members 22. Dovetail tenons 80 are slideably received in mortises 40 of respective side and central stringers thereby mateably joining the central stringers to respective side stringers. Additionally, upper and lower shoulders 46 and 48 are opposingly spaced to accommodate the full thickness of tread member 22 in close fitting abutment. In this manner, the full weight of a user rests on the lower shoulder 46 of respective recessed mortises 40 upon ascent or descent of the stair 10. Tenons 80 serve to maintain stringers 12, 14 and 16 in fixed spatial relation, but do not bear the full user weight. This construction enables a thinner tread member to be employed than would normally be required, while further reducing stair 10 weight and construction expense. The recessed mortise 40 may include the dovetail mortise presently illustrated in FIG. 8 or any other laterally locking mortise.

As shown in FIG. 8, a bit 82 may be employed to form the recessed mortise 40. The bit 82 comprises a shank 84, a recess cutting portion 86, and a mortise cutting portion 88.

Figure 12:
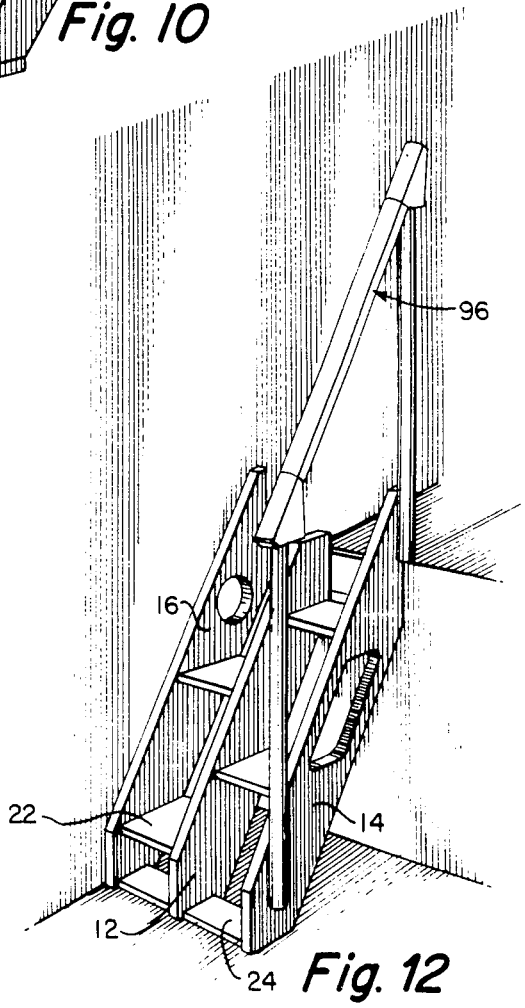
FIG. 12 is a perspective view of a stair in accordance with the present invention having a single handrail and adapted for mounting against a sidewall.

For increased user comfort and safety, the stair 10 may be provided with one or more handrails 28, 30. The handrails 28 and 30 are disposed above and sustantially parallel to the side stringers 14 and 16. Upper handrail supports 90 and lower handrail supports 92 are provided to maintain and support the handrails in position above the side stringers 14 and 16. For longer stairway embodiments, additional handrail supports 94 may be provided to secure the handrails in their use position. Handrails are disposed above the respective side stringers at a height and lateral spacing such that the handrails provide relatively close body guidance above the waistline. The user is thus afforded considerably more security than would be provided by conventional wider spaced handrails, which are typically located at a lower level. When the stair is disposed against a wall a single handrail 96 may be employed, as illustrated in FIG. 12.

Handrails may be constructed with terminal members 98 which join handrail supports 92 and elongated handrail members 100. In a typical embodiment shown in FIG. 9, the terminal member 98 includes a substantially triangular member 102 having an opening 104 on a lower face 106 mateable with the handrail support 92, the latter illustrated as being of cylindrical cross section. An upper face 108 mates with the elongated handrail member 100. Upper face 108 and elongated handrail member 100 may be joined by dowels 110 which may be glued in bores 112 provided in respective faces of the elongated handrail member 100 and upper face 108. A protective end plate 114 may be attached to triangular member 102 in a like manner, or by any other suitable fastening technique.

Figure 11:
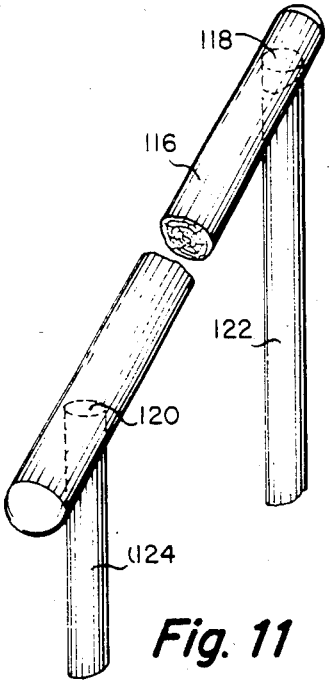
FIG. 11 is a perspective view of an alternate handrail configuration.

An alternate handrail embodiment is shown in FIG. 11. A handrail 116 includes blind bores 118 and 120 provided in the upper and lower ends of the handrail 116. The bores are sized to receive upper and lower handrail supports 122 and 124. Additional handrail supports may be provided as previously discussed.

Figure 11A:
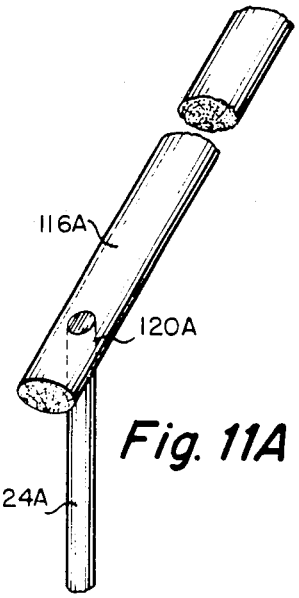
FIG. 11A is a partial perspective view of another handrail configuration.

In another embodiment illustrated in FIG. 11A, a handrail 116A includes through bores, such as bores 120A sized to receive handrail 124A.

As can be seen in FIG. 2, a single carpet runner 126 may be secured on tread members 22 on respective sides of the central stringer 12. The carpet is secured to the back edge 72 of one tread member 22 and extends forward to the front edge 70 of tread member 130 across the foot support portion 128. The carpet is next run to the back edge 72 of the next lower tread member 132 and forward across the foot support portion 128 to the front edge 70. In this manner, all tread members on respective sides of the central stringer may be carpeted. Carpeting provides greater user comfort, and prevents a user from seeing through the stair, which may extend to a considerable elevation.

In lieu of or in addition to carpeting disposed in the above described manner, a non-skid material may be disposed on the tread members 22 to improve safety of ladder use.

The stair of the present invention may be fabricated of wood, plastic, or any other suitable material of sufficient strength. Tread members 22 slide into recessed mortises 40 of stringers 12, 14, and 16 without the use of tools, to permit ease of assembly. Handrail supports 90 and 92 may be fastened to the side stringers 14, 16 using screws, bolts or any other suitable fastening means. Mounting panels 24 and 26 may be readily fastened to the stringers and confronting surfaces by the use of screws, glue or other suitable fastening means. The stair of the present invention may be shipped in a disassembled state as a compact, lightweight package and then assembled and installed with relative ease at a location of intended use.

The above described invention is illustrative of a novel stair permitting disassembled shipment and rapid installment in an intended use location. Other modifications and embodiments of the present invention are possible without departing from the inventive concept disclosed therein. The invention is therefore to be considered limited only by the scope of the following claims.

I claim:

1. A stair comprising:

a central stringer having first and second sides, a front edge and a rear edge and adapted for mounting between an upper level and a lower level at a specified angle of inclination, said central stringer having a plurality of substantially horizontal recessed dovetail mortises disposed in alternating arrangement on respective sides of the stringer and extending substantially from said front edge to said rear edge;

side stringer disposed on respective first and second sides of the central stringer, each side stringer having a central stringer facing side, a front edge and a rear edge, and at least one substantially horizontal recessed dovetail mortise in the central stringer facing side extending substantially from the respective side stringer front edge to the rear edge in corresponding opposed relation to the central stringer recessed mortises; and a plurality of tread members, at least one of said tread members having opposing ends of a defined length with dovetail tenons extending therefrom along substantially the entire length of the respective ends, the tread member ends being slidably disposed in the respective central and side stringer recessed mortises to interlock the respective central and side stringers in fixed spatial relation and maintain the tread members in alternating arrangement on respective sides of the central stringer;

wherein each of the central and side stringer recessed dovetail mortises includes a substantially rectangular recess defining upper and lower shoulders, and each dovetail mortise is centrally disposed with respect to the recess.

2. The stair of claim 1 wherein each of the tread members has a width to confront upper and lower recess shoulders upon slideable engagement of tread member tenons with recessed mortises, the weight of a user, upon application to each tread member, being primarily supported by respective side and central stringer recessed mortise lower shoulders.

3. The stair of claim 1 wherein the central stringer, side stringers and plurality of tread members are fabricated of wood.

4. The stair of claim 1 wherein the central stringer, side stringers and plurality of tread members are fabricated of plastic.

5. The stair of claim 1 further including at least one handrail disposed above at least one of said side stringers at a height to pass diagonally across the waistline level of a user while descending the stair, each of the handrails being supported by a plurality of handrail support members.

6. The stair of claim 5 including at least one terminal member comprising:

a substantially triangular body having a handrail confronting face and a handrail support confronting face and further including;

means for fastening the handrail in confronting relation with the handrail confronting face of the terminal member; and means for fastening the handrail support in confronting relation with the handrail support confronting face of the terminal member.

7. The stair of claim 1 including an uppermost tread member having an upper surface substantially coplanar with the upper level and wherein the central stringer includes a portion extending above the upper level to guide the foot of a user upon entry or exit of the stair.

8. The stair of claim 1 including an upper mounting panel adjacent the upper level, and a lower mounting panel adjacent the lower level, each of said panels adapted to be fastened to the central stringer and respective side stringers and disposed for attachment to a confronting surface to fixably position the stair in a use position.

9. The stair of claim 1 wherein each of said stringers includes:

an elongated front member of substantially rectangular cross section;

an elongated rear member of substantially rectangular cross section; and a plurality of cross members, each fastened respectively to front and rear members to maintain the front and rear members in fixed spatial relation, said cross members being disposed in positions corresponding to intended locations of recessed mortises in the central and side stringers respectively.

10. The stair of claim 1 including an uppermost tread member having a top surface which is substantially coplanar with the upper level.

11. The stair of claim 10 wherein the uppermost tread member has a front to back depth approximately one half the front to back depth of lower tread members.

12. The wooden stair of claim 11 further including at least one wooden handrail disposed above at least on of said side stringers at a height to lie just below the armpit of a user while descending the stair, each of the handrails being supported by a plurality of wooden handrail support members.

13. The stair of claim 1 wherein the stair is adapted to be disposed at an angle of inclination to the lower level in excess of 45 degrees.

14. A wooden stair comprising:

a wooden central stringer having first and second sides and adapted for mounting between an upper level and a lower level at a specified angle of inclination, said central stringer having a plurality of recessed dovetail mortises disposed in alternating arrangement on respective sides of the stringer;

wooden side stringers disposed on respective first and second sides of the central stringer, each side stringer having a central stringer facing side and at least one substantially horizontal recessed dovetail mortise in the central stringer facing side in corresponding opposed relation to the central stringer recessed dovetail mortise;

said recessed dovetail mortises including a substantially rectangular recess defining upper and lower shoulders and a dovetail mortise disposed centrally with respect to the recess;

a plurality of wooden tread members having dovetail tenons on opposing ends of the members, the tread member ends being slideably disposed in the respective central and side stringer recessed dovetail mortises to interlock the respective central and side stringers in fixed spatial relation and maintain the tread members in alternating arrangement on respective sides of the central stringer, the tread members each having a thickness to confront upper and lower recess shoulders upon slideable engagement of tread member dovetail tenons with respective recessed dovetail mortises, the weight of a user, upon application to each tread member, being primarily supported by respective side and central stringer recessed mortise lower shoulders.

* * * * *

UNITED STATES PATENT AND TRADEMARK OFFICE

CERTIFICATE OF CORRECTION

PATENT NO. : 4,627,200

DATED : December 9, 1986

INVENTOR(S) : James M. Lapeyre

It is certified that error appears in the above-identified patent and that said Letters Patent is hereby corrected as shown below: On the Title Page:

AFTER THE ABSTRACT

"14 Claims, 12 Drawing Figures" should read --14 Claims, 13 Drawing Figures--

Column 1, line 19, "may shipped" should read --may be shipped--

Column 2, line 17, "typc ially" should read --typically--

Column 4, line 43, "sustantially" should read --substantially--

Column 5, line 12, "such as bores" should read --such as bore--
line 47, "installment" should read --installation--

Column 6, line 9, "slidably" should read --slideably--

Column 7, line 15, "claim 11" should read --claim 14--
line 16, "least on of" should read --least one of--

Signed and Sealed this

Twenty-sixth Day of July, 1988

*Attest:*

DONALD J. QUIGG

*Attesting Officer*

*Commissioner of Patents and Trademarks*